United States Patent [19]

Butler

[11] 4,011,554

[45] Mar. 8, 1977

[54] INTRUSION ALARM APPARATUS

[75] Inventor: George N. Butler, Boca Raton, Fla.

[73] Assignee: Butler & Law Incorporated, Deerfield Beach, Fla.

[22] Filed: June 3, 1976

[21] Appl. No.: 692,330

[52] U.S. Cl. ..... 340/274 R; 340/214; 340/258 B; 340/283

[51] Int. Cl.[2] ..... G08B 13/26

[58] Field of Search ..... 340/283, 258 B, 258 C, 340/214, 274 R

[56] References Cited

UNITED STATES PATENTS

| | | | |
|---|---|---|---|
| 3,313,960 | 4/1967 | Boris | 340/258 C |
| 3,465,325 | 9/1969 | Goldfarb et al. | 340/258 C |
| 3,623,063 | 11/1971 | Fontaine | 340/283 |
| 3,648,076 | 3/1972 | Lester | 340/258 C |

*Primary Examiner*—Glen R. Swann, III
*Attorney, Agent, or Firm*—Oltman and Flynn

[57] ABSTRACT

This intrusion alarm apparatus is intended to be suspended from an inside doorknob and plugged into an A.C. power socket at the premises to be protected. A test switch and indicator lamp enable the user to determine (without triggering an alarm) whether the plug has the correct polarity in the power socket. The alarm signalling device in the apparatus or the indicator lamp is activated by the added capacitance of a person or an extraneous metal object touching the outside doorknob, depending upon whether the switch is in the "test" or "on" position.

6 Claims, 2 Drawing Figures

INTRUSION ALARM APPARATUS

BACKGROUND OF THE INVENTION

Various alarm devices have been proposed heretofore which sound or otherwise signal an alarm when a person touches the doorknob on the outside of a door leading into the premises to be protected. Examples of such prior proposals include: "Popular Electronics" magazine, February, 1969, pp. 92–93; U.S. Pat. No. 3,465,325 to Goldfarb et al.; and U.S. Pat. Nos. 3,508,239 and 3,623,063 to John V. Fontaine.

Touch-activated switch circuits of general application are shown in: U.S. Pat. Nos. 3,530,310 and 3,549,909 to Adelson et al.; U.S. Pat. No. 3,549,905 to Johnson; "Popular Electronics" magazine, April, 1969, pp. 56–58; and "Popular Science" magazine, February, 1973, pp. 124–125.

SUMMARY OF THE INVENTION

The present invention relates to an A.C. powered intrusion alarm apparatus which operates on the touch-activation principle. The apparatus is suspended by a chain or other metallic device from the inside of a metal doorknob on a wooden or other non-conductive door. The alarm is activated when a person or a metal object held by him, such as a key, touches the outside doorknob. To accommodate a wide variety of user installation conditions, a sensitivity adjustment is an integral part of the circuit and the sensitivity can be set high enough so that touching the doorknob with a heavy rubber or fabric glove will trigger the alarm, as will approaching the doorknob while attempting to tamper with the doorlatch with a plastic credit card or similar dielectric object, by capacitive coupling between the hand and the outside doorknob. A metallic or otherwise electrically conductive object would only trigger the alarm sooner. Such a degree of sensitivity is sufficiently below the threshold of spontaneous triggering as to make the intrusion alarm apparatus simultaneously highly reliable yet immune from false alarms.

In accordance with the present invention, a test switch is provided in the alarm apparatus to enable the user to determine (without signalling an alarm) whether the power plug has been inserted into the A.C. power socket with the correct polarity. After such determination has been made with the switch in its "test" position, the switch may be shifted to its "on" position in which the apparatus is ready to signal an alarm in response to the touch or close approach of an intruder on the outside doorknob.

A principal object of the present invention is to provide a novel and improved A.C. powered, touch-activated, intrusion alarm apparatus which combines extreme simplicity with the added capability of letting the user know whether it has been properly plugged into an A.C. power socket.

Another object of this invention is to provide such an apparatus having a test switch which enables the user to make the determination of plug polarity silently and without any danger of signalling an alarm, but under the same condition (i.e., touching the doorknob) that will trigger the alarm when the apparatus is in normal use.

BRIEF DESCRIPTION OF THE DRAWING

Further objects and advantages of this invention will be apparent from the following detailed description of a presently-preferred embodiment thereof, shown in the accompanying drawing in which.

DESCRIPTION OF THE PREFERRED EMBODIMENT

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Figure 1:
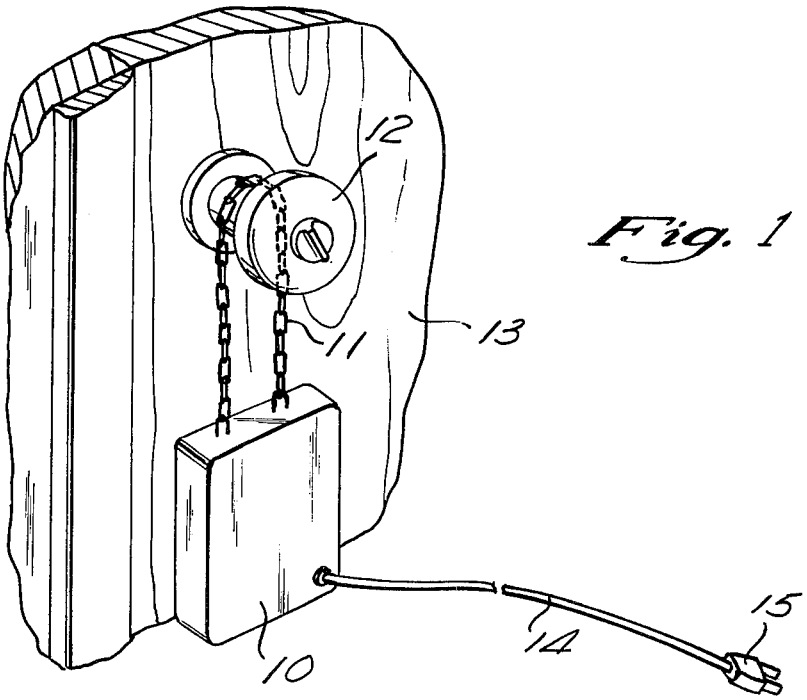
FIG. 1 is a perspective view showing the present alarm apparatus suspended from a doorknob at the inside of a door.

Referring first to FIG. 1, the present alarm apparatus has a small housing 10 with a chain 11 of electrically conductive metal by which it is suspended from an electrically conductive metal doorknob 12 on the inside of a door 13 of wood or other suitable electrically non-conductive material. A two-wire power cord 14 extends from the lower end of the housing 10 and carries a two-pronged plug 15 for insertion in the usual 117 volt A.C. wall socket (not shown) of the electrical wiring system of the premises to be protected.

Figure 2:
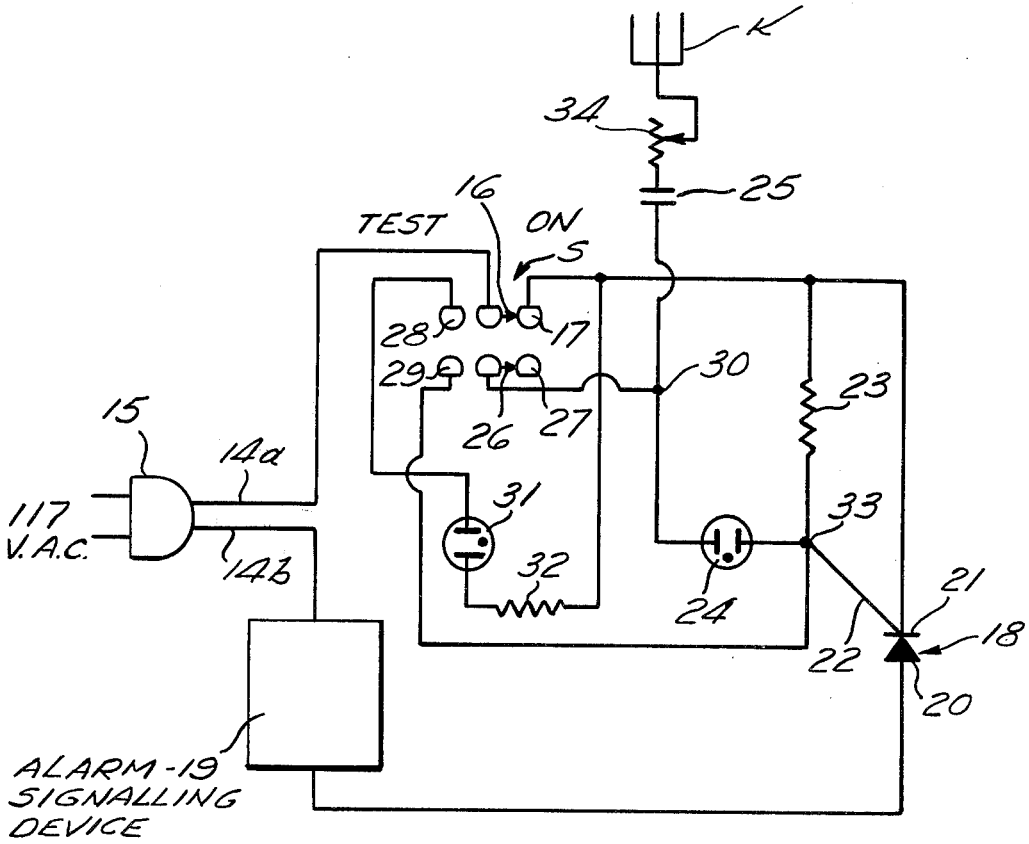
FIG. 2 is a schematic electrical circuit diagram of this alarm apparatus.

Enclosed within the housing 10 are all of the components of the electrical circuit shown in FIG. 2 except the power plug 15, the two wires **14*a* and 14*b* of the power cord 14, and the sensor K, which includes the chain 11, the inside doorknob 12**, and the doorknob (not shown) on the outside of the door.

Referring to FIG. 2, the circuit shown there comprises, in series across the power lines **14*a* and 14*b*, a set of switch contacts 16 and 17 of a manually operated test switch S, the cathode-anode path of a silicon-controlled rectifier 18, and an electrically operated alarm signalling device 19, such as a bell or other audible sounding device. It will be apparent that with the switch contacts 16, 17 closed, the alarm signalling device 19 will be energized whenever the SCR 18** conducts current through its anode-cathode path.

The SCR has an anode 20, a cathode 21 and a gate electrode 22. A bias resistor 23 is connected between the cathode 21 and the gate 22 of the SCR. A first gaseous glow discharge tube 24, such as a neon tube, is connected between the gate 22 of the SCR and one terminal of a capacitor 25, whose opposite terminal is connected through a variable resistor 34 to the sensor K.

The previously-mentioned switch contacts 16, 17 are part of a test switch S having two ganged mobile contacts 16 and 26 which are individually engageable, respectively, with a first pair of fixed contacts 17 and 27 or with a second pair of fixed contacts 28 and 29. As shown in FIG. 2, the mobile switch contacts 16 and 26 are in the "on" position of the switch, engaging the fixed contacts 17 and 27 respectively. The lower mobile switch contact 26 is connected to the juncture 30 between the glow discharge tube 24 and the capacitor 25.

Variable resistor 34 provides a sensitivity adjustment connected in series between sensor K and capacitor 25.

The switch also has a "test" position, in which the mobile switch contacts 16 and 26 engage the opposite pair of fixed contacts 28 and 29. Switch contact 28 is connected through a second glow discharge tube 31 and a resistor 32 to the cathode 21 of SCR 18. The other fixed contact 29 of this second pair is connected directly to the juncture 33 between the SCR gate 22, the lower end of resistor 23 and the first glow discharge tube 24.

The switch S is set in its "test" position when the user wants to determine whether the plug 15 is plugged into the wall socket with the correct polarity. The power line **14*b* should be connected to the neutral terminal of the wall socket for the alarm circuit to operate. With the apparatus hanging on the doorknob as shown in FIG. 1, when the plug 15 is inserted into the wall socket with the correct polarity and the switch S is in the "test" position (with its mobile contacts 16 and 26 engaging the fixed contacts 28 and 29**), the circuit operates as follows:

The SCR is maintained non-conductive even if a person touches the doorknob, thereby connecting the sensor K to neutral potential. The potential at the cathode 21 of the SCR is kept substantially below the voltage on the "hot" wire **14*a* because of the series resistance of the second glow discharge tube 31 and resistor 32. The circuit from the "hot" wire 14*a* to the gate 22 of the SCR includes glow discharge tube 31 and resistors 32 and 23**. The net effect of these impedances is to prevent the SCR from turning on when the doorknob is effectively connected to neutral potential.

The "test" glow tube 31 turns on when a person touches the doorknob, completing a circuit from the "hot" wire **14*a* to neutral via the switch contacts 16, 28, tube 31, resistor 32, resistor 23, switch contacts 29, 26, capacitor 25, variable resistor 34, and sensor K. The fact that tube 31 is illuminated tells the user that the plug 15** is in the power socket with the correct polarity.

If the plug polarity were incorrect and wire **14*a* were connected to the neutral terminal of the socket, then the tube 31 would not turn on as a result of a person touching the doorknob, there being substantially no potential difference between the nowneutral wire 14*a* and the person touching the doorknob. The failure of tube 31** to turn on would tell the user that the plug must be reversed in the socket for the alarm apparatus to be operable.

With the determination having been made that the plug 15 is in the socket with the correct polarity, the user shifts the switch S from the "test" position to the "on" position (shown in FIG. 2). In this position, the switch open-circuits the glow discharge tube 31 and resistor 32 and it removes the previous short-circuit around the glow discharge tube 24.

Now if a person touches the doorknob, this completes a circuit from the "hot" wire **14*a* to neutral through the switch contacts 16, 17, resistor 23, glow discharge tube 24, capacitor 25, variable resistor 34, and sensor K. This gates on the SCR, whose amode-cathode path completes an energization circuit for the alarm signalling device 19**, which will remain on as long as the person continues to touch the doorknob.

If the plug polarity were incorrect, with the switch S in the "on" position its contacts 16, 17 would connect the neutral wire **14*a* to the gate 22 of the SCR (via resistor 23). A person touching the doorknob would not thereby produce a gate signal that would turn on the SCR because there would be little or no potential difference between the neutral wire 14*a* and the sensor K, and the first glow discharge tube 24** would not fire.

In one practical embodiment, resistor 23 has a resistance of 22,000 ohms and resistor 32 a resistance of 10,000 ohms, the capacitor 25 has a capacitance of 1,000 micro-microfarads, each of the glow discharge tubes 24 and 31 is a type NE-2H neon tube manufactured by Chicago Miniature, Chicago, Ill. model no. C2A, and the SCR 18 is a General Electric Co. model no. C106B1. Variable resistor 34 has a maximum resistance of 3 megohms. Instead of a bell or buzzer, the alarm signalling device 19 might be a siren, light, telephone, camera, sound recorder or other electrically operated device suitable for this purpose.

From the foregoing it will be evident that the present alarm apparatus is extremely simple in its circuitry yet versatile in its operation, enabling the user to assure himself that the power plug is in the socket with the correct polarity. This indication of plug polarity is obtained in the "test" position of the switch without any chance of sounding the alarm, which can happen only when the switch has been placed in its "on" position. Also, the testing for plug polarity is based on the same condition (i.e., touching the doorknob) as will be involved in the actual operation of the apparatus after the switch has been shifted to its "on" position.

By suitable adjustment of variable resistor 34, the apparatus can be made so sensitive that the alarm signalling device will be turned on in response to a close approach to, but not direct touching of, the outside doorknob by a person, as already explained.

I claim:

1. In an A.C.-powered alarm apparatus having:

an electrical plug for insertion in an A.C. power socket;

and an electrical circuit connected to said plug and including: capacitive switch means; and means for signalling an alarm in response to the operation of said capacitive switch means;

the improvement which comprises:

test switch means in said circuit which is operable a. in a first position to disable said alarm signalling means from being operated by said capacitive switch means, and b. in a second position to enable said alarm signalling means for operation by said capacitive switch means;

and electrically-energized polarity indicator means connected to said test switch means a. in said first position of the latter to indicate whether the plug is inserted in the A.C. power socket with the correct polarity for operating said alarm signalling means, and b. to be disabled in said second position of the test switch.

2. An alarm apparatus according to claim 1 wherein said polarity indicator means is a glow discharge tube which a. in said first position of said test switch means is connected between one terminal of said plug and said capacitive switch means for operation by the latter, and b. in said second position of said test switch means is open-circuited.

3. An alarm apparatus according to claim 2, wherein said means for signalling an alarm comprises an alarm signalling device and an SCR connected in series with each other across the terminals of said plug in said second position of said test switch means, said SCR having a gate electrode operatively coupled to said capacitive switch means in said second position of said test switch means to turn on the SCR in response to actuation of said capacitive switch means.

4. In an A.C.-powered, touch-activated alarm apparatus having:

an alarm signalling device;

an SCR operatively connected to said alarm signalling device to activate the latter when the SCR is turned on;

an electrical plug for insertion in an A.C. power socket;

a sensor operatively coupled to said SCR to turn on the SCR in response to the introduction in circuit with the sensor of a body having appreciable capacitance;

and a circuit for connecting said plug to said SCR and said alarm signalling device to energize them from said A.C. power socket;

the improvement which comprises:

electrically energizable polarity indicating means for indicating whether said plug is inserted in said A.C. power socket with the correct polarity;

and test switch means in said circuit operable:

a. in a first position to operatively connect said polarity indicating means to said plug for energization from said A.C. power socket if the plug polarity is correct and to disable said SCR from being turned on from said sensor; and b. in a second position to disable said polarity indicating means from being energized and to connect said SCR for operation from said sensor.

5. An alarm apparatus according to claim 4, wherein said circuit includes:

a bias resistor connected between the cathode and gate of the SCR;

a first glow discharge tube connected between said sensor and the gate of the SCR;

and a second resistor connected between the cathode of the SCR and said test switch means;

and wherein:

said polarity indicating means is a second glow discharge tube connected in series with said second resistor between said test switch means and the cathode of the SCR;

said test switch means in its first position connects said second glow discharge tube and said second resistor to one terminal of said plug and provides a connection from the gate of the SCR to said sensor which short circuits said first glow discharge tube;

and said test switch means in its second position open circuits said second glow discharge tube and said second resistor, connects said one terminal of the plug to the cathode of the SCR, and open-circuits said last-mentioned connection from the gate of the SCR to said sensor.

6. An alarm apparatus according to claim 5, wherein said circuit includes:

a capacitor and a variable resistor connected in series with each other between said sensor and first glow discharge tube.

* * * * *